US008833008B2

(12) United States Patent
Truckner

(10) Patent No.: US 8,833,008 B2
(45) Date of Patent: Sep. 16, 2014

(54) METHOD AND APPARATUS FOR ATTACHING A RAIL SUPPORT POST TO A STAIR

(75) Inventor: Richard P. Truckner, Hayward, CA (US)

(73) Assignee: EZ Stairs, Inc., Laguna Hills, CA (US)

( * ) Notice: Subject to any disclaimer, the term of this patent is extended or adjusted under 35 U.S.C. 154(b) by 963 days.

(21) Appl. No.: 13/055,712

(22) PCT Filed: May 13, 2008

(86) PCT No.: PCT/US2008/006136

§ 371 (c)(1),
(2), (4) Date: Jan. 24, 2011

(87) PCT Pub. No.: WO2009/064320

PCT Pub. Date: May 22, 2009

(65) Prior Publication Data

US 2011/0167740 A1 Jul. 14, 2011

Related U.S. Application Data

(60) Provisional application No. 61/003,416, filed on Nov. 16, 2007.

(51) Int. Cl.
*E04F 11/00* (2006.01)
*E04F 11/18* (2006.01)

(52) U.S. Cl.
CPC ..... *E04F 11/181* (2013.01); *E04F 11/1838* (2013.01)
USPC ..... 52/191

(58) Field of Classification Search
CPC ..... E04F 11/00
USPC ..... 52/182, 184, 185, 186, 188, 191
See application file for complete search history.

(56) References Cited

U.S. PATENT DOCUMENTS

| | | | | | |
|---|---|---|---|---|---|
| 838,266 | A | * | 12/1906 | McKee et. al | 52/184 |
| 1,568,568 | A | * | 1/1926 | Nagin | 52/191 |
| 2,867,855 | A | * | 1/1959 | Xanten | 182/97 |
| 3,018,077 | A | | 1/1962 | Buehler | |
| 3,196,997 | A | * | 7/1965 | Hager | 52/182 |
| 3,994,113 | A | * | 11/1976 | Souza, Jr. | 52/741.2 |
| 4,050,203 | A | * | 9/1977 | Souza, Jr. | 52/185 |
| 4,124,957 | A | * | 11/1978 | Poulain | 52/183 |
| 4,709,520 | A | | 12/1987 | Vochatzer | |
| 4,948,100 | A | | 8/1990 | Stevens | |
| 5,456,451 | A | | 10/1995 | Eyler, Jr. | |
| 5,535,557 | A | | 7/1996 | Garber | |
| 5,584,469 | A | | 12/1996 | Goodwin | |
| 5,636,483 | A | * | 6/1997 | Wille | 52/188 |
| 5,695,175 | A | | 12/1997 | Hawkins | |

(Continued)

*Primary Examiner* — Mark Wendell
*Assistant Examiner* — Keith Minter
(74) *Attorney, Agent, or Firm* — Walker, McKenzie & Walker, P.C.

(57) ABSTRACT

A method and apparatus is disclosed for mounting a rail support post to the perimeter of a stairway having stingers at the edge of the stairway and treads, risers and possibly blocking laterally across the stairway. The apparatus includes a bracket member that is attached to or against the interior of a stringer and includes at least one hole for accommodating a fastener that passes through the stringer and into or through a post member at the outside surface of the stringer. The bracket includes flanges that attach to a rise or a tread and/or a block to secure the assembly together.

11 Claims, 5 Drawing Sheets

(56) References Cited

U.S. PATENT DOCUMENTS

| | | | | |
|---|---|---|---|---|
| 5,983,580 | A * | 11/1999 | Carr | 52/187 |
| 6,145,814 | A | 11/2000 | Perrot | |
| 6,354,403 | B1 | 3/2002 | Truckner et al. | |
| 6,397,529 | B1 * | 6/2002 | Grenier | 52/182 |
| 6,481,697 | B1 | 11/2002 | Brown | |
| 6,763,912 | B2 * | 7/2004 | Robinson et al. | 182/115 |
| 6,868,944 | B2 * | 3/2005 | Truckner et al. | 182/228.1 |
| 6,905,110 | B2 | 6/2005 | Brown | |
| 7,047,699 | B2 | 5/2006 | Kennedy | |
| 7,096,592 | B2 * | 8/2006 | Truckner | 33/562 |
| 7,946,085 | B2 * | 5/2011 | Prins | 52/191 |
| 8,307,603 | B1 * | 11/2012 | Mitchell et al. | 52/741.2 |
| 2005/0160688 | A1 | 7/2005 | Truckner et al. | |
| 2007/0017169 | A1 | 1/2007 | Gibson | |
| 2007/0113493 | A1 | 5/2007 | Gibson | |
| 2007/0246698 | A1 | 10/2007 | Truckner et al. | |
| 2009/0151275 | A1 * | 6/2009 | Naccarato et al. | 52/182 |

* cited by examiner

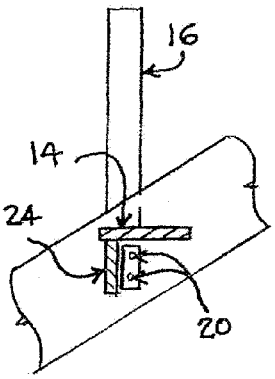
FIG. 13
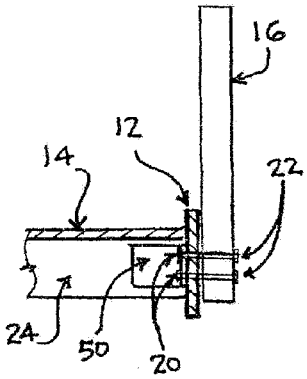
FIG. 14
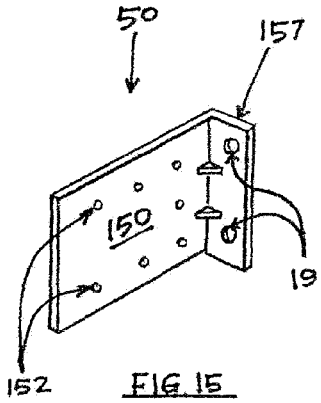
FIG. 15
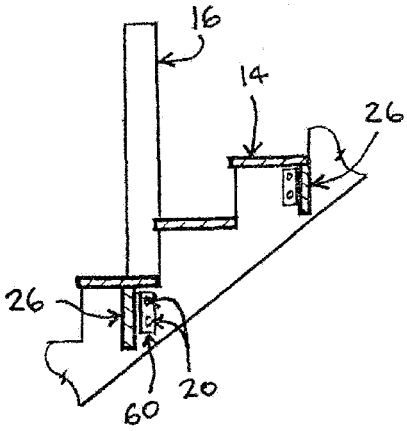
FIG. 16
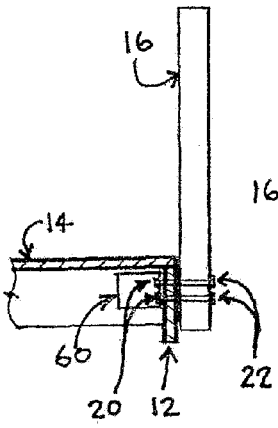
FIG. 17
Fig. 18
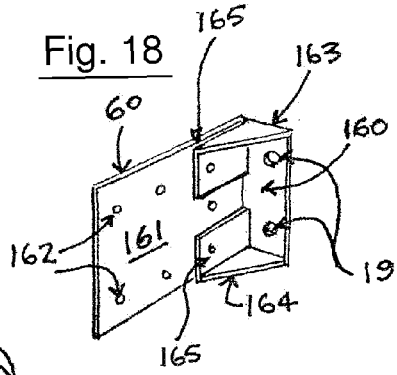
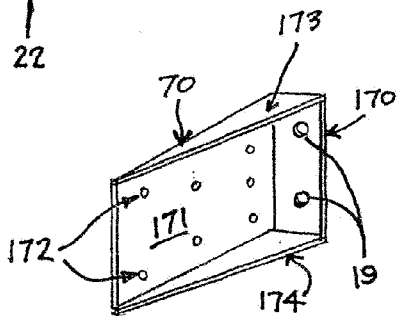
FIG. 19

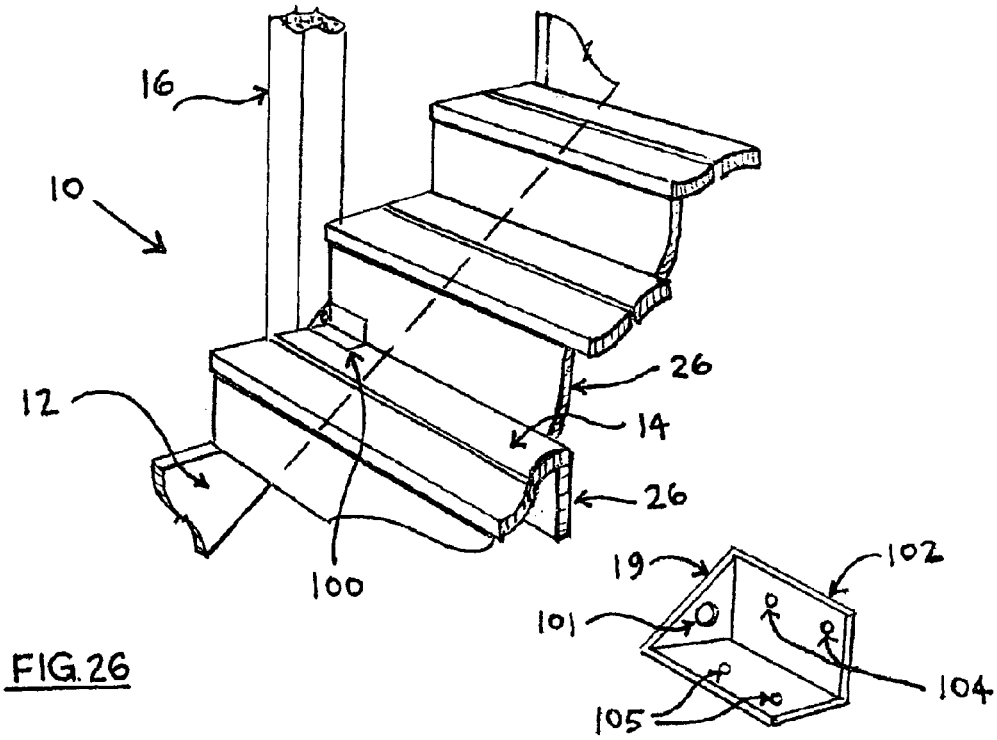
FIG. 26
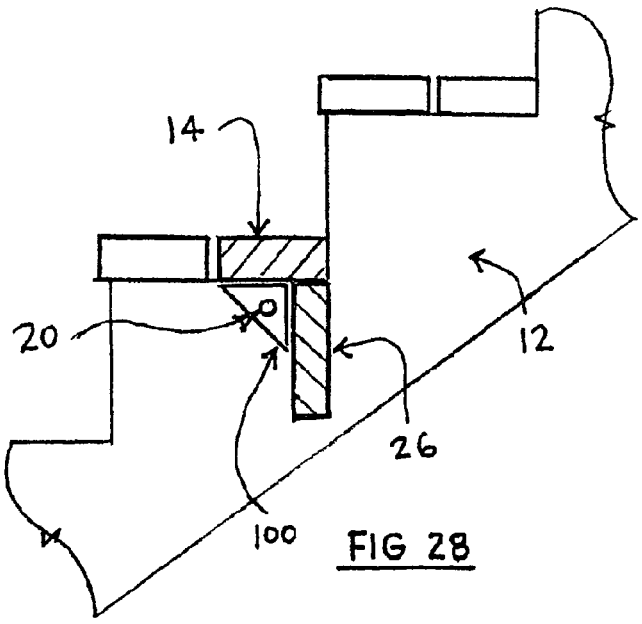
FIG. 27
FIG 28

METHOD AND APPARATUS FOR ATTACHING A RAIL SUPPORT POST TO A STAIR

CROSS REFERENCE TO RELATED APPLICATIONS

This application claims priority benefit of U.S. Provisional Application No. 61/003,416 (filed Nov. 16, 2007) and of International Application PCT/US2008/006136 (filed May 22, 2009).

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

When stairways having a stringer, risers, treads and blocking are constructed there is frequently a need, and sometimes a code requirement, for a hand rail at one or both sides of the stair for persons to grab when using the stairway. The hand rail is usually attached to one or more posts that are at either or both sides of the stairway. The hand rail should be firm and should be able to resist vertical, horizontal and angular forces that result from the user or other forces that may be applied to the hand rail. The firmness of the hand rail to support forces is dependent upon the attachment between the hand rail to the posts and the attachment of the posts to the stairway or other supports related to the stairway. The present invention relates to the attachment of a rail support post to a stair.

2. Information Disclosure Statement

It is known to attach a rail support post to a stringer along the side of a stair by bolting or nailing the post to the exterior of the stringer. It is also known to fix a support post in the area surrounding the stair without attachment to the stair. These two methods for positioning a post with respect to a stair have minimal strength with respect to the stair.

Known patented or published systems include:

Gibson, U.S. Patent Appl. Publication No. US 2007/0113493 A1 (published May 24, 2007), and Gibson, U.S. Patent Appl. Publication No. US 2007/0017169 A1 (published Jan. 25, 2007), both of which show no structural attachment of a post to a stair, both include anchoring the handrail independent of the stringer, their rail posts are not attached to a stringer, riser strips are not connected to a tread to form a structural "L" shape, and their posts are not structurally attached to the stringer.

Vochatzer, U.S. Pat. No. 4,709,520 (issued Dec. 1, 1987), does not show a means for rail post attachment, brackets are attached to a tread only, and no "L" shaped structure is shown.

Kennedy, U.S. Pat. No. 7,047,699 (issued May 23, 2006), discloses a post attachment to a steel bleacher—not a wooden stair, attachment of rails is shown on exterior surfaces of a rise or tread, no attachment to a stringer, and posts are not attached by through bolts.

Brown, U.S. Pat. No. 6,905,110 B2 (issued Jun. 14, 2005), and Brown, U.S. Pat. No. 6,481,697 B1 (issued Nov. 19, 2002), both show a post attachment for a temporary railing, the posts do not attach to outside surface of a stringer, the attachment needs multiple bracket components not one single bracket, the attachment does attach to a rise and tread but needs multiple components for the attachment.

Garber, U.S. Pat. No. 5,535,557 (issued Jul. 16, 1996), does not use a bracket attached against a stringer or attached to a structural "L" shape.

Eyler, Jr., U.S. Pat. No. 5,456,451 (issued Oct. 10, 1995), shows a rail mounted to the top of a tread only.

None of these known patents address the firm connection of a rail support post to a stair by firmly connecting the rail post against a stair stringer, and connected to a rise, or a tread, and/or block so as to transfer lateral forces applied against the rail support post to shear forces against the internal elements of the stair including at least one of a rise, a tread and/or a blocking structure within the stair.

BRIEF SUMMARY OF THE INVENTION

The method and apparatus of the present invention not only provides a convenient way of attaching a post member to a stairway but also conforms to many building code requirements. In many jurisdictions building codes require that a hand rail be provided along the side of a stairway that rises a specified vertical distance and that the hand rail be attached to vertical posts spaced a along the stairway. Further, building codes require that the post must be able to withstand specified horizontal forces applied against the post without failure of the means and method of attachment of the post to the stairway. A testing of stair structures by Testing Engineers, Inc. of San Leandro, Calif. includes a testing in accordance with a test procedure TEC QC Manual, SOP 20.160 as a certification of construction of a Deck Post Support—Lateral Loading with Stringer using the construction of the present invention for conformance to specified building codes. Testing was done in accord with International Builders Code 2006 (IBC 2006) and International Residential Code 2006 (IRC 2006).

The present invention provides a firm connection of a rail support post to a stair by a combination of firmly connecting the post to the stringer, riser, blocking or tread of a stair. The firm connection of the post to the stair is accomplished by providing a bracket member that is positioned on the interior of the stair to the inside of a stringer, a surface of a rise, a surface of a tread, and/or a surface of a block or a combination of these attachments. The bracket provides holes or other cutout surfaces for passing a threaded bolt through the bracket, the stringer and through holes passing through the post and threading a nut onto the bolt to accomplish the firm attachment of the rail support post to the stair at the exterior of the stringer. A lag bolt passing partially through the post can also attach the post to the bracket and the stair.

In accord with the present invention, brackets of various materials and configurations are used to enhance the structural attachment of a rail support post to a stair. The brackets are first positioned against the stair stringer. The brackets are then attached to the stair rise or tread, and/or blocking depending on the bracket configuration and stair construction.

At least one bolt hole is located in each bracket. The post is placed in position on the outside of the stringer and at least one hole is drilled through the stringer from the inside guided by the post attachment hole in the bracket. The bracket may be provided with more than one bolt hole for the drilling of attachment holes through the stringer and the post.

An object of the present invention is a method and apparatus for attaching a post to the exterior of a stairway in a way that provides strength and security to the attachment of the post and its support of a hand railing.

A further object of the invention in accord with the preceding object is to provide an apparatus that can be easily attached to an existing stairway having a stringer, a rise, a tread, or a block and adapted to be used in attaching a post to exterior of the stairway to provide a secure and firm attachment between the post and the stairway through the stinger without structurally involving the stringer.

Further objects and features of the invention will be readily apparent to those skilled in the art in view of the following description and accompanying drawings.

BRIEF DESCRIPTION OF THE SEVERAL VIEWS OF THE DRAWING

The present invention is illustrated by way of example, and not by way of limitation, in the figures of the accompanying drawings, where:

FIG. 13 is a partial sectional view of another form of attachment of a post to a solid stringer, rise and tread.

FIG. 14 is a partial sectional view of the attachment of FIG. 13.

FIG. 15 is an enlarged perspective view of the bracket illustrated in FIGS. 13 & 14.

FIG. 16 is a partial sectional view of another form of attachment of a post to a cut stringer and tread.

FIG. 17 is a partial sectional view of the attachment of FIG. 16.

FIG. 18 and FIG. 19 are perspective views of alternative forms of the bracket shown in FIGS. 16 & 17.

FIG. 26 is a perspective illustration of a post attachment to a stairway using a bracket of the present invention a tread and blocking.

FIG. 27 is a perspective view of the bracket shown in FIG. 26.

FIG. 28 is a partial sectional view illustrating the use of the bracket of FIG. 27 on the inside surfaces of a stringer, tread and blocking or rise.

DETAILED DESCRIPTION OF THE INVENTION

Throughout the following description, specific details are set forth in order to provide a more through understanding of the invention; however, the invention may be practiced without these particulars. In other instances, well known elements may not be shown are described to avoid unnecessarily obscuring the invention. Accordingly, the specification and drawings are to be regarded in an illustrative, rather than a restrictive, sense. It is also to be understood that the terminology used herein is for the purpose of describing particular embodiments of the invention only, and is not intended to limit the scope of the invention in any manner.

Figure 1:
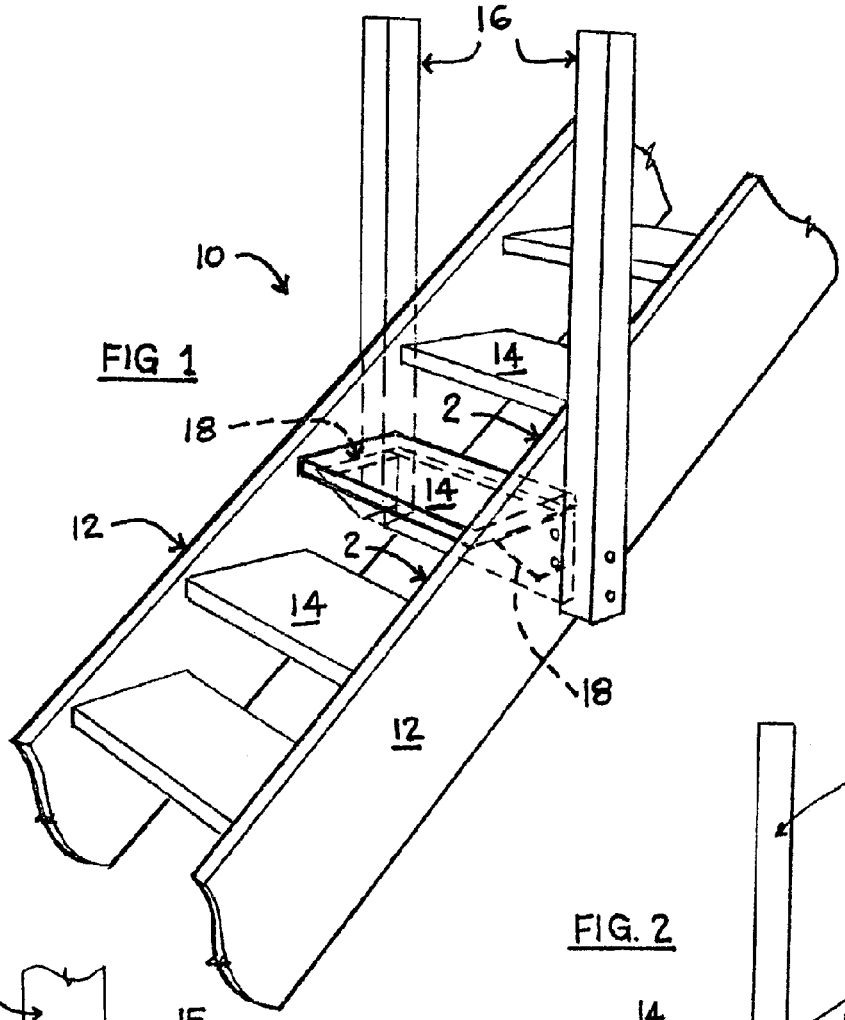
FIG. 1 is a perspective view of a stairway with post attachment at either side of the stairway.

FIG. 1 illustrates a perspective view of a stairway 10 including at each side of the stairway a stringer 12, a plurality of treads 14, a post 16, and brackets 18 (in dotted lines) for attaching the posts 16 to the stairway using attachment means such as bolts 20 with nuts 22, or the like, passing through the bracket 18, the stringer 12 and at least into the post 16 to secure the post 26 to the stairway. The bracket 18 includes flanges (to be more fully described hereafter) that are attached by suitable attachment means to the tread 14 (or rise or block as will be further described hereafter) and to thus provide a connection between the post 16 and the tread 14 and the stringer 12.

Figure 2:
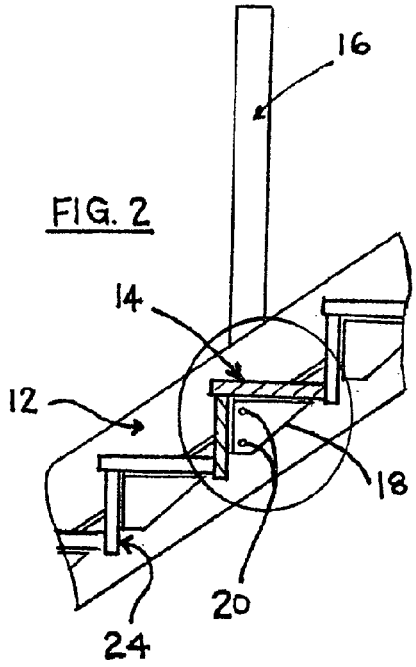
FIG. 2 is a sectional view taken along the lines 2-2 of FIG. 1.
Figure 3:
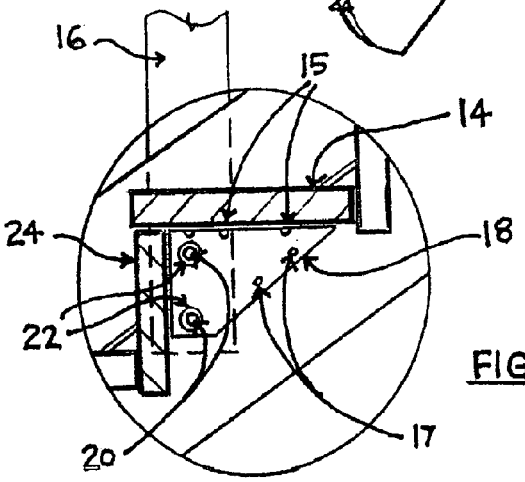
FIG. 3 is an enlarged view of the circled portion of FIG. 2.
Figure 7:
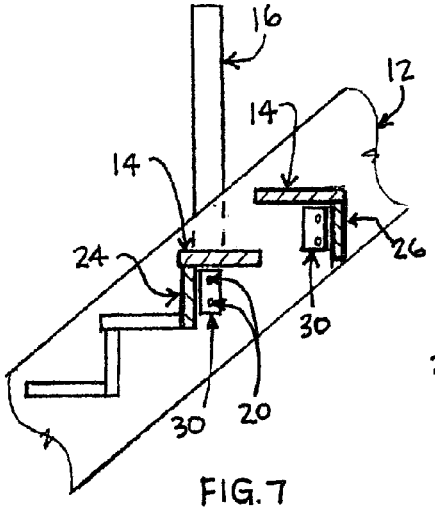
FIG. 7 is a partial sectional view illustrating a post attachment in a stairway having a cut stringer, with rise, treads and a block.
Figure 10:
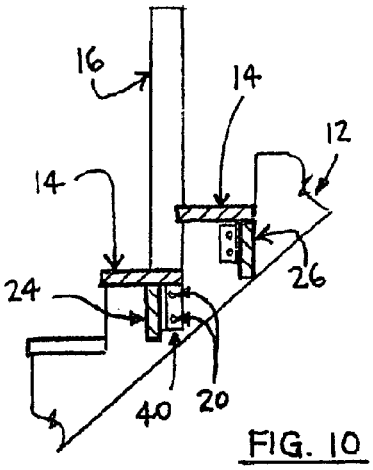
FIG. 10 is a partial sectional view of another form of bracket of the present invention for attaching a post to a cut stringer.

The stringer 12 illustrated in FIG. 1 is a solid, one piece element along each side of the stairway 10. In FIGS. 2 and 3 (and in other FIGs of this specification) the stringer is illustrated either as a solid element, or an adjustable, parallel two piece stringer as illustrated in FIGS. 2 & 3 and described in my U.S. Pat. No. 6,354,403, or a cut stringer as illustrated in FIGS. 7 & 10. The stringer 12, in whatever form, is along the side of the stairway and the treads 14 extend laterally across the stair and are attached to the stringer by suitable means, for instance the brackets described in my issued US patent, or to a cut surface in a cut stringer. A rise 24 also extends laterally across a stair and is attached to the stringer as is a tread and further may be attached to a surface of a tread 14 by suitable means. In the case of a cut stringer, the rise 24 and the tread 14 can be attached to cut stepping surfaces along the stringer. A blocking member is frequently used in conjunction with the treads, the blocking is the equivalent of a rise at the back side of a tread where no rise is used or at the beginning base form of the stair where the stringer meets a foundation. In this instance the rise or the blocking is attached firmly to the foundation to prevent lateral movement. A blocking member may extend laterally across the interior of the stairway or be positioned in the interior of a wide stairway spaced between the stringers at each side.

The present invention provides for a firm connection of a rail support post by providing a firm connection between the post, the stringer, the bracket and at least a tread, a rise or a blocking member. That connection of the bracket to the rise or tread forms an "L" shaped structure with surfaces that are perpendicular to the axis of a post being attached to the exterior of a stairway stringer. As will be described hereinafter, the bracket of the present invention includes surfaces that are attached to or positioned against the face of a stringer and flanges that are attached to surfaces of a rise, a tread, and/or a block. The post is then attached to the bracket by attachment means extending through the bracket, the stringer and into the post with the stringer between the post and the bracket. Lateral forces applied to the post with respect to the longitudinal axis of the stairway apply forces to the bracket on the interior of the stringer and stairway and those forces are translated to shear forces against the attachment of the flanges of the bracket to the rise, or tread, and/or block and add a mechanical advantage to the attachment of the post to the stairway.

In FIGS. 2 & 3 illustrating a stairway 10 with both rise 24 and treads 14, the bracket 18 is shown attached to the interior surface of the stringer by suitable attaching means such as screws 17 and to the under surface of tread 14 by suitable attaching means such as screws 15. It should be noted that the bracket 18 in FIGS. 2 & 3 is in a reverse orientation to the bracket 18 shown in FIG. 1 because the FIG. 1 illustration is on a stairway with only treads 14 and no risers 24. In FIG. 1 the bracket 18 is shown in conjunction with a tread 14 and a block 26 behind the bracket 18. The connection of the bracket 18 and tread 14 and block is still the same "L" connection.

Figure 4:
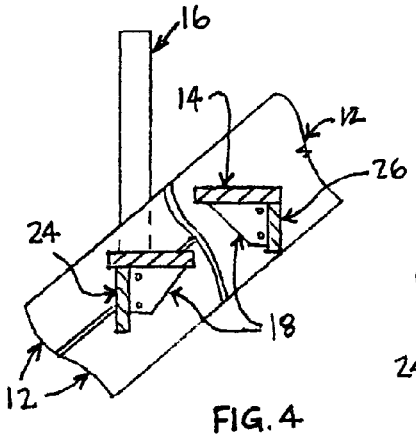
FIG. 4 is a partial sectional view of a post support system through a tread, rise, and blocking and illustrating the present invention installed against a solid stringer (one piece or two piece stringer).
Figure 5:
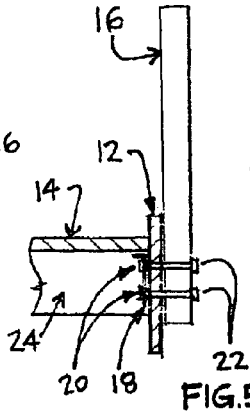
FIG. 5 is a partial sectional view through a stringer and illustrating the attachment of the present invention bracket to the inside surface of a rise, a tread and a stringer.
Figure 6:
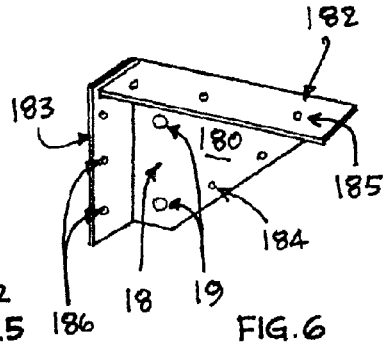
FIG. 6 is an enlarged perspective view of the bracket shown in FIGS. 3 & 4.

FIGS. 4, 5 & 6 illustrate a post 16 support system using a bracket 18, a tread 14 and a rise 24. The bracket is attached to the interior of the stringer by bolts extending through the bracket, the stringer and the post 16. The bracket is also attached to the rise or tread by suitable means. In FIG. 4 a block 26 is illustrated at the back surface of a tread 14 and illustrates the bracket 18 in a reversed orientation to that shown at the post to demonstrate that the bracket can be attached to a rise, a tread and/or a block 26.

FIG. 5 illustrates a section through the stringer and shows the bolts 20 passing through the bracket 18, the stringer 12 and the post 16.

FIG. 6 illustrates in perspective the bracket 18 having a first surface 180 with flanges 182 and 183 extending perpendicular to the first surface 180, and the flanges are perpendicular to each other. Holes 19 are provided in the first surface 180 to accommodate the bolts 20 (or lag screws) for connecting the bracket 18, a stringer 12 and a post 16 as well as holes 184 for attaching the bracket to a stringer. The flanges 182 and 183 have suitable holes 185 and 186, respectively, for attaching the bracket 18 to a rise 24, a tread 14, or a block 26 as illustrated in FIG. 4.

Figure 8:
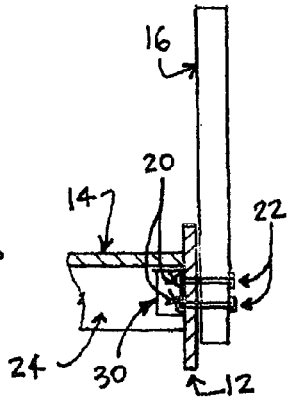
FIG. 8 is a partial sectional view of the assembly of FIG. 7.
Figure 9:
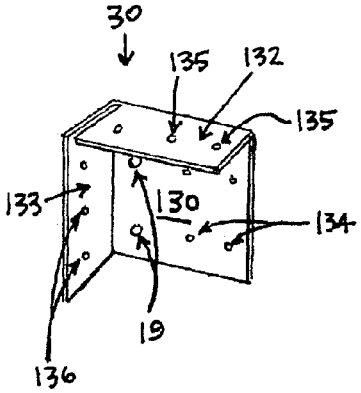
FIG. 9 is an enlarged perspective view of the bracket shown in FIGS. 7 & 8.

FIGS. 7, 8 & 9 illustrate a post support system using an alternative form of a bracket from that shown in FIG. 6. This bracket 30 is shown in FIG. 7 as attached to a cut stringer 12 and either a rise 24 and a tread 14 or a tread 14 and a block 26. FIG. 8 illustrates the bracket 30 attaching a post 16 and stringer 12 with bolts. FIG. 9 illustrates the bracket 30 with a first surface 130 with holes 134, perpendicular flanges 132 and 133 with holes 135 and 136, respectively; those holes for mounting the bracket 30 to the interior face of the stringer 12 and to surfaces of a rise 24, tread 14 and/or a block 26. The bracket 30 is also provided with holes 19 for accommodating bolts 20 (or lag screws) for connecting the bracket, a stringer and a post.

Figure 11:
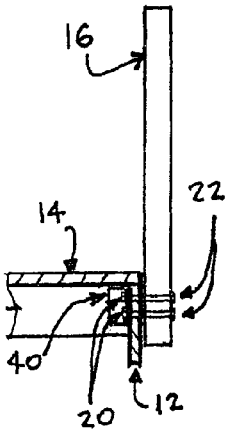
FIG. 11 is partial sectional view of the assembly of FIG. 10.
Figure 12:
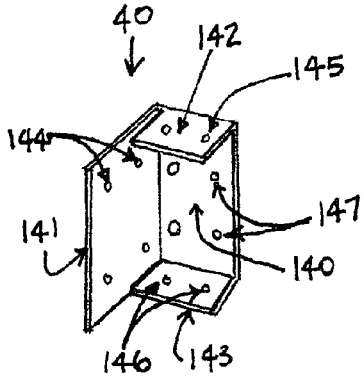
FIG. 12 is an enlarged perspective view of the bracket shown in FIGS. 10 & 11.

FIGS. 10, 11 & 12 illustrate another alternative post support system with a bracket 40 illustrated in use in FIGS. 10 & 11. This bracket has a first surface 140; three flanges 141, 142 and 143, each perpendicular to the first surface 140 and flanges 142 and 143 are parallel to each other and perpendicular to flange 141. Suitable holes 144, 145 and 146 are provided, respectfully, in flanges 141, 142 and 143 to accommodate attachment means to attach the bracket to a rise, tread or block, and first surface 140 includes holes 147 for attaching the bracket to the face of a stringer. Holes 19 are provided in the first surface 140 for accommodating bolts 20 that will pass through the bracket 140, a stringer 12 and into a post 16. The purpose of the parallel flanges 142 and 143 is to permit the bracket 40 to be reversible and used at either side of a stairway in connecting the bracket to a stringer and to rise, tread and/or block.

FIGS. 13 & 14 and FIGS. 16 & 17 illustrate another alternative form of bracket for use with a stairway that is designed to attach to the riser or blocking of a stairway. In the form of FIGS. 13, 14 & 15 a bracket 50 has a first surface 150 and only one flange 151. The first surface 150 includes holes 19 for accommodating bolts 20 that connect the bracket 50, the stringer 12 and the post 16. The flange 151 has a plurality of holes 152 for attaching the flange to a rise or block (not shown). The face of the bracket between the first surface 150 and the flange 151 is provided with pressed strengthening forms that assist in maintaining the perpendicular relationship of the first surface 150 and the flange 151. This form of a bracket can be reversed and used at either side of a stairway.

FIGS. 16 & 17 illustrate a bracket as shown in FIG. 15 used with a cut stringer.

FIGS. 18 & 19 illustrate further alternatives in bracket formation. FIG. 18 illustrates a bracket 60 which can be formed from a single piece of metal with a first surface 160 with holes 19 for accommodating mounting bolts 20 and a perpendicular flange 161 with holes 162 for accommodating attachment means for attaching the flange 161 to a block 26 as shown in FIG. 16 illustrating mounting on a cut stringer 12. The bracket 60 includes strengthening elements 163 and 164 at each side of the first surface and the elements 163 and 164 have ears 165 and 166, respectively. This form of bracket can be formed from a single metal piece and the folded elements and ears can be welded or attached to the flange 161 to provide strength. This form of bracket could be used in connecting the bracket to a rise or a block and can be reversible to be used at either side of the stairway.

FIG. 19 illustrates another alternative form for a bracket 70 having a first surface 171 with holes 19 for accommodating bolts 20 and a perpendicular flange 171 with holes 172 for accommodating attachment means for attaching the flange 171 to a rise or block as shown in FIG. 13 or 16. The bracket 70 may be fabricated from a single piece of metal and the first surface 170 or the flange 171 can be formed with long elements 173 and 174 that can be welded or attached by suitable means to either the first surface or the flange to provide a strengthening structure. This form of bracket can be reversible and used at either side of a stairway.

Figure 20:
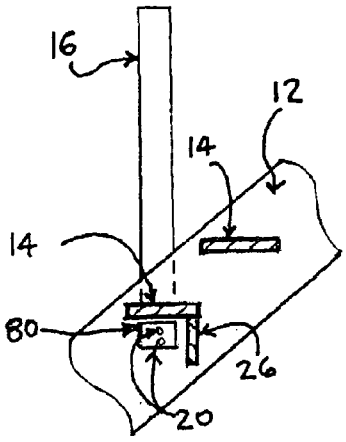
FIG. 20 is a partial sectional view of another form of attachment of a post to a solid stringer and tread.
Figure 21:
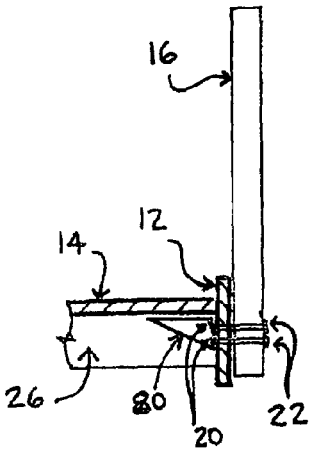
FIG. 21 is a partial sectional view of the attachment of FIG. 20.
Figure 22:
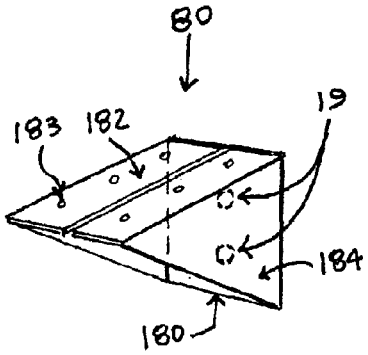
FIG. 22 is a perspective view of the bracket shown in FIGS. 20 & 21.
Figure 23:
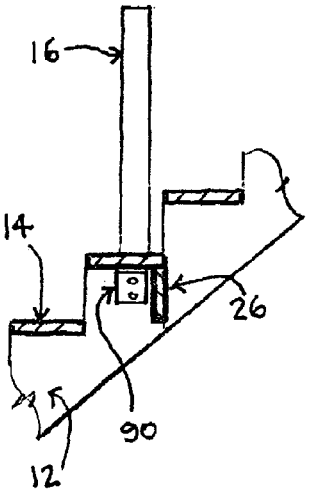
FIG. 23 is a partial sectional view of another form of attachment of a post to a cut stringer and tread.
Figure 24:
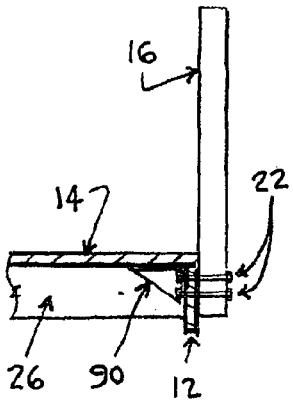
FIG. 24 is a partial sectional view of the attachment of FIG. 23.
Figure 25:
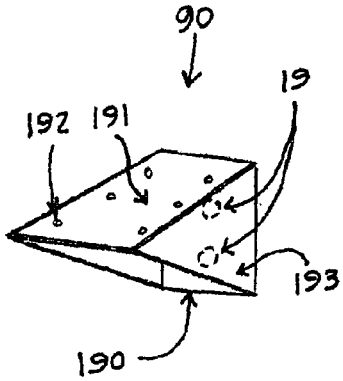
FIG. 25 is a perspective view of the bracket shown in FIGS. 23 & 24.

FIGS. 20, 21 & 22 and FIGS. 23, 24 & 25 illustrate two additional alternative forms for the brackets. FIG. 22 illustrates a bracket with a first surface 180 including holes 19 for accommodating bolts 20 and a pair of flange surfaces 181 and 182 formed from folded sides 184 and 185 of the first surface 180. Flange surfaces 181 and 182 include holes 183 for accommodating mounting means for attaching the flange to the undersurface of a tread as illustrated in FIGS. 20 & 21. The first surface 180 can be mounted to the interior face of a stringer 12 and bolts 20 can pass through the bracket, the stringer 12 and into a post 16. This form of bracket is reversible and can be used at either side of the stairway. FIGS. 23, 24 & 25 illustrate another form of bracket 90 and it use with a cut stringer in FIGS. 23 & 24. This bracket includes a first surface 190 with holes 19 for accommodating bolts 20 and a flange 191 perpendicular to the first surface with holes 192 for accommodating mounting means for attaching the bracket to the undersurface of a tread 14. The bracket is also formed with elements 193 and 194 folded either from the first surface 190 or the flange 191. The elements 193 and 194 are adapted to connect the first surface and the flange at mating edges as by being welded to the other surface to strengthen the bracket. This bracket is also reversible and useable at either side of a stairway.

FIG. 26 illustrates a bracket member 100 used on the exterior surface of a tread 14 for attachment of a post 16 against the outside of a stringer 12 with the stairway treads 14 and rise 26 against the inside of the stringer 12. As shown in FIG. 27, the bracket 100 has a first surface 101, with a hole 19 for accommodating a mounting bolt or lag screw, a pair of flanges 102 and 103 with holes 104 and 105, respectively, for accommodating screws or the like for attachment of the bracket to the tread and rise, as shown in FIG. 1. This bracket form provides the "L" shaped structure that transfers lateral forces against the post 16 into shear forces in the connections to the tread 14 and rise 26. FIG. 28 illustrates the use of this bracket 100 on the underside of a tread and the connection to a block 26.

In each of the bracket configurations illustrated in the drawings, the brackets are used to connect a post against the exterior surface of a stringer with the bracket on the inside of the stringer; the brackets include flanges that are used to connect the bracket to treads or rise or blocking depending upon the construction of the stairway. The feature that make the present invention effective in providing a firm connection of a rail support post to a stair is the ability to transfer lateral forces applied against the post above the level of a stringer into compressive forces on the first surface of the bracket against the inside of the stringer and distribute those forces into shear forces against the attachment means connecting the flanges of the bracket to the tread or rise or blocking. The shear forces are distributed to the attachment means along the flanges through the "L" shaped structure of the rise, tread or blocking perpendicular to each other. It is believed that the connection of a bracket structurally to a rise, tread, or block or combination thereof in the "L" shaped connection to achieve structural integrity is a novel application of the present invention because, in the prior art, rise, treads or blocks or combination of the same are not used to provide structural support for post support in conventional stair construction.

A test of the method and apparatus of the present invention has shown a significant increase in strength of the connection and an ability to withstand higher lateral forces applied to the post before failure of the structure. Many building code requirements, for example the 2006 IRC and 2006 IBC, require that the post to stairway connection be able to withstand "a (200 pound) single concentrated load applied in any direction" but it is known that accepted engineering practice calls for a safety factor of 2.5 or 3.0, depending on the application, when testing structural connections—thus the need to test at a 500 pound load. In a test of the apparatus of the present invention progressively greater loads were applied 42 inches up the post from the tread until the assembly failed. Of three test trials, the lowest point of failure was at 570 pounds; the highest load withstood was 617 pounds.

While certain preferred embodiments of the invention have been specifically disclosed, it should be understood that the invention is not limited thereto as many variations will be readily apparent to those skilled in the art and the invention is to be given its broadest possible interpretation within the terms of the following claims.

I claim:

1. In combination, a bracket, a rail support post, and a stair, said stair comprising:

(a) a stair stringer extending along a side of said stair, said stringer having an outside surface and an inside surface;

(b) a vertical member selected from the group consisting of a rise and a block, said vertical member extending transversely across said stair, said vertical member being attached to said stringer; and (c) a tread extending transversely across said stair, said tread being attached to said stringer;

said bracket having a substantially flat body portion and a first flange extending perpendicular to said body portion, one of said body portion or said first flange being adjacent said inside surface of said stringer and the other of said body portion or said first flange being attached to said stair so that lateral load forces applied to said post are transferred through said bracket to said stair;

said rail support post being adjacent said outside surface of said stringer;

a first bolt passing through said post, said stringer, and said one of said body portion or said first flange of said bracket and fixedly entrapping said post, said stringer, and said one of said body portion or said first flange of said bracket between a first head of said first bolt and a first nut threadedly engaged with said first bolt; and a second bolt passing through said post and said stringer and fixedly attaching said post to said stringer.

2. The combination as recited in claim 1, in which said tread has an underside, said body portion of said bracket is adjacent said stringer, and said flange of said bracket is attached to said underside of said tread of said stair.

3. The combination as recited in claim 2, in which said second bolt also passes through said body portion of said bracket, and fixedly entraps said post, said stringer, and said body portion of said bracket between a second head of said second bolt and a second nut threadedly engaged with said second bolt.

4. The combination as recited in claim 1, in which said body portion of said bracket is adjacent said stringer and said flange of said bracket is attached to said vertical member.

5. The combination as recited in claim 4, in which said vertical member is said rise.

6. The combination as recited in claim 4, in which said vertical member is said block.

7. The combination as recited in claim 4, in which said second bolt also passes through said body portion of said bracket, and fixedly entraps said post, said stringer, and said body portion of said bracket between a second head of said second bolt and a second nut threadedly engaged with said second bolt.

8. The combination as recited in claim 1, in which said flange of said bracket is adjacent said stringer, and said body portion of said bracket is attached to said vertical member so that lateral load forces applied to said post are transferred through said bracket to said vertical member.

9. The combination as recited in claim 8, in which said vertical member is said rise.

10. The combination as recited in claim 8, in which said vertical member is said block.

11. The combination as recited in claim 8, in which said second bolt also passes through said flange of said bracket, and fixedly entraps said post, said stringer, and said flange of said bracket between a second head of said second bolt and a second nut threadedly engaged with said second bolt.

* * * * *